US008464832B1

(12) United States Patent
Rullo

(10) Patent No.: US 8,464,832 B1
(45) Date of Patent: Jun. 18, 2013

(54) LENGTH ADJUSTING DEVICE HAVING A ROTATED AND ELONGATED EYE

(75) Inventor: James Rullo, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 0 days.

(21) Appl. No.: 12/701,160

(22) Filed: Feb. 5, 2010

(51) Int. Cl.
*A62B 1/14* (2006.01)

(52) U.S. Cl.
USPC ..... 182/5; 182/192; 182/193

(58) Field of Classification Search
USPC ..... 182/5, 192, 193
See application file for complete search history.

(56) References Cited

U.S. PATENT DOCUMENTS

| | | | | |
|---|---|---|---|---|
| 2,393,519 | A * | 1/1946 | Crowther | 411/320 |
| 3,638,980 | A * | 2/1972 | Kleinhenn | 411/320 |
| 3,653,659 | A * | 4/1972 | Zinkin | 482/49 |
| 4,253,218 | A * | 3/1981 | Gibbs | 24/134 R |
| 4,542,884 | A * | 9/1985 | Dodge, Jr. | 254/391 |
| 4,560,029 | A * | 12/1985 | Dalmaso | 182/5 |
| 4,657,110 | A * | 4/1987 | Wolner | 182/5 |
| 5,316,103 | A * | 5/1994 | Bell et al. | 182/18 |
| 5,638,919 | A * | 6/1997 | Pejout | 182/192 |
| 5,924,522 | A * | 7/1999 | Ostrobrod | 182/191 |
| 5,927,438 | A * | 7/1999 | Ostrobrod | 182/241 |
| 6,382,355 | B1 * | 5/2002 | Kowalewski | 182/133 |
| 2002/0014370 | A1 * | 2/2002 | Casebolt et al. | 182/5 |
| 2004/0129494 | A1 * | 7/2004 | Cherpitel | 182/5 |
| 2006/0102421 | A1 * | 5/2006 | Dionne | 182/5 |

OTHER PUBLICATIONS

Define cable found in Action The American Heritage® Dictionary of the English Language, Fourth Edition copyright © 2000 by Houghton Mifflin Company. Updated in 2009. Published by Houghton Mifflin Company. All rights reserved.*

Buckingham Manufacturing Co., Inc. BuckGrab (PN 5004B) Length adjusting device (LAD) retrofit instructions.

* cited by examiner

*Primary Examiner* — Katherine Mitchell
*Assistant Examiner* — Daniel Cahn
(74) *Attorney, Agent, or Firm* — Mark Levy; David L. Banner; Hinman, Howard & Kattell, LLP

(57) ABSTRACT

A LAD assembly having a cam with engaging teeth rotatably mounted in a housing, the distal end of the cam assembly having an eye with a central opening. An axis passing through the central opening is parallel to parallel planes defined by the inside sides of the housing. This results in an eye that is rotated 90° relative to the eyes of other rope grabs. In addition, the cam assembly may be elongated, thereby placing the eye further from the body than the eyes of prior art rope grab devices. The orientation and optional extension of the eye allows a carabiner or the like attached to the eye to lie in a plane orthogonal to the plane of a carabiner attached to a prior art rope grab device. This, in combination with the extension of the eye away from the body, allows easier access to and operation of the cam assembly by a user.

1 Claim, 6 Drawing Sheets

LENGTH ADJUSTING DEVICE HAVING A ROTATED AND ELONGATED EYE

FIELD OF THE INVENTION

The invention pertains to length adjusting devices (LADs) and, more particularly, to a length-adjusting device having an elongated eye disposed 90° to a major surface of the cam of the adjuster.

BACKGROUND OF THE INVENTION

Length adjusting devices (LADs) are often referred to by a variety of names by arborists, linesmen, climbers, and other workers or athletes engaged in aerial pursuits. Other such terms include rope grabs, rope adjusters, rope clamps, ascenders, descenders, descent control devices, microscenders, micrograb rescuescenders, etc. These devices typically consist of a frame supporting an axle around which an engaging cam may pivot. The cam has engaging teeth on a portion of its outer perimeter. Rotation of the cam moves these engaging teeth between: a position at which a rope or webbing may readily slide between an inner portion of the frame and the engaging teeth; and a position where the engaging teeth prevent passage of the rope or webbing through the frame. An eye or other connection point is fixed on an outer arm of the cam assembly. The eye allows attachment of a device (e.g., a work positioning lanyard, carabiner, or the such) to a body belt D-ring or attachment device to the length adjusting device.

For simplicity, the term length adjusting device as used herein is intended to include any length-adjusting device that utilizes a cam that bears rope or webbing engaging teeth, such devices intended to selectively allow and disallow passage of rope or webbing through the device.

Referring to FIGS. 1*a* and 1*b*, there are shown an exploded view and an assembled view, respectively, of a rope grab of the prior art, generally at reference number 100. Rope grab 100 is a length adjusting device (LAD) Model 5004B known as a "Buckgrab" manufactured by Buckingham Manufacturing Co., Inc. of Binghamton, N.Y. Rope grab 100 has a body 102 and axle 104, a cam assembly 106 having a proximal cam end 108 with engaging teeth 110 and having a hole 112 therethrough. A nut 114 is used to secure axle 104 bearing cam 106 within body 102. A cable 116 is used to secure cam 106 to body 102 when rope grab 100 is disassembled to insert a rope or webbing 118.

As may readily be seen, cam 106 has an eye 120 disposed at a distal end 122 of cam assembly 106. The eyehole 124 has an axis 126 that is substantially perpendicular to the plane of the paper on which FIG. 1*b* appears and perpendicular to the major axis 128 of cam assembly 106.

The distal cam end 122 serves as a release to allow passage of rope or webbing 118 by causing rotation of cam assembly 106 around axle 104. The rotation of cam 106 about axle 104 selectively engages and disengages the engaging teeth 110 against rope or webbing 118, thereby to selectively allow and disallow passage of rope or webbing through body 102.

The orientation of cam eyehole 124 (FIGS. 1*a* and 1*b*) is problematic as discussed in detail hereinbelow.

DISCUSSION OF THE RELATED ART

Several rope grab devices may be found in the prior art. For example, U.S. Pat. No. 4,657,110 for INERTIAL ROPE GRAB, issued Apr. 14, 1987 to J. Thomas Wolner discloses a safety device that may be removably fastened to a safety line and that incorporates both inertial and positive locking features.

U.S. Pat. No. 5,316,103 for ROPE GRAB DEVICE INDICATING THE EXISTENCE OF SHOCK IMPACT ON PERSONAL SAFETY, issued May 31, 1994 to Michael Bell et al. teaches a rope grab that protects a worker at an elevated position from a fall.

U.S. Pat. No. 5,156,240 for ROPE GRAB, issued Oct. 20, 1992 to Meyer Ostrobrod shows a rope grab that releasably attaches a workman's safety belt lanyard to a vertically extending safety rope.

U.S. Pat. No. 5,924,522 for CABLE GRAB, issued 5 Jul. 20, 1999 to Meyer Ostrobrod discloses another apparatus that releasably attaches a workman's safety belt lanyard to a vertically extending safety rope.

U.S. Pat. No, 6,712,181 for SAFETY ROPE GRAB DEVICE, issued Mar. 30, 2004 to Steve Nichols teaches a Prusik knot that functions as a rope grab.

None of the aforementioned patents, taken singly or in any combination, are seen to teach or suggest the novel LAD assembly of the present invention.

SUMMARY OF THE INVENTION

In accordance with the present invention there is provided a LAD assembly having a cam with engaging teeth rotatably mounted in a housing. The distal end of the cam assembly has an eye that is rotated 90° to the conventional orientation of LAD eyes. In addition, the cam assembly is elongated, thereby placing the eye further from the body than the eyes of prior art rope grab devices. The orientation and extension of the eye in the novel LAD device of the present invention allows a carabiner attached to the eye to lie in a plane orthogonal to the plane of a carabiner attached to a prior art rope grab device. This, in combination with the extension of the eye away from the body, allows easier access to and operation of the cam assembly by a worker wearing gloves, thereby helping prevent pinching of fingers between the attached carabiner and the LAD body. This provides enhanced safety to the user of the LAD and more reliable operation by users wearing gloves.

It is, therefore, an object of the invention to provide a LAD having an eye oriented at 90° to eyes of prior art rope grabs.

It is another object of the invention to provide a LAD having an eye oriented at 90° and wherein the eye is displaced further from the LAD body than eyes of prior art rope grabs.

It is an additional object of the invention to provide a LAD having an eye oriented at 90° that allows an attached carabiner or similar device to lie in a plane that minimizes interference with the operation of the LAD.

It is a further object of the invention to provide a LAD having an eye oriented at 90° that eliminates a potential pinch point between an attached carabiner or similar device and the fingers of a worker operating the LAD.

It is yet another object of the invention to provide a LAD having an eye oriented at 90° that effectively operates with a work positioning lanyard for readily adjusting the length thereof without allowing LAD to flip upside down.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a LAD assembly having a cam with engaging teeth rotatably mounted in a housing. The distal end of the cam assembly has an eye that is rotated 90° to the conventional orientation of rope grab eyes. In addition, the cam assembly may be elongated, thereby placing the eye farther from the body than the eyes of prior art rope grab devices. The orientation and optional extension of the eye in the novel LAD device of the present invention allows a carabiner attached to the eye to lie in a plane orthogonal to the plane of a carabiner attached to a prior art rope grab device.

Figure 2A:
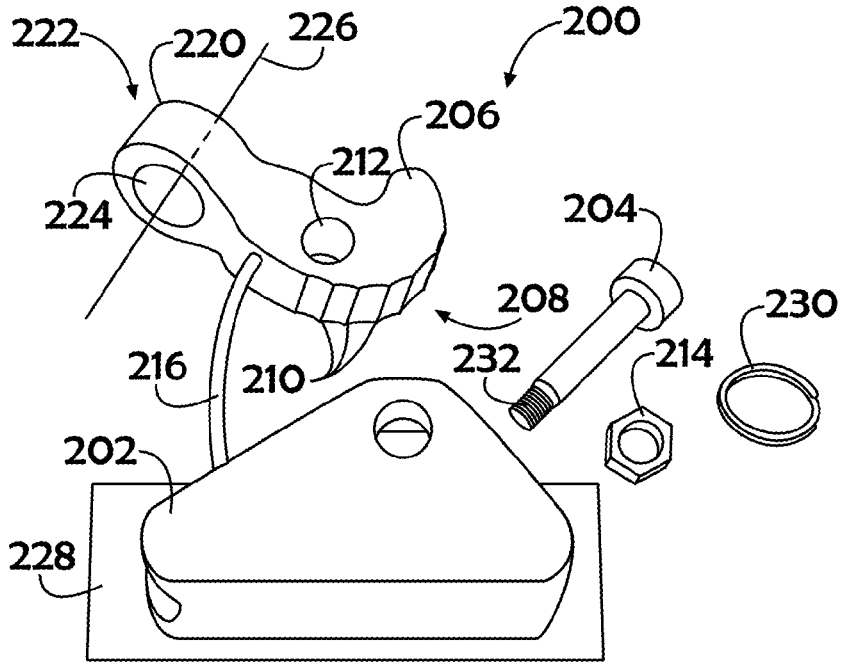
FIGS. 2*a* and 2*b* are exploded and assembled pictorial, schematic views, respectively, of a LAD in accordance with the present invention.
Figure 2B:
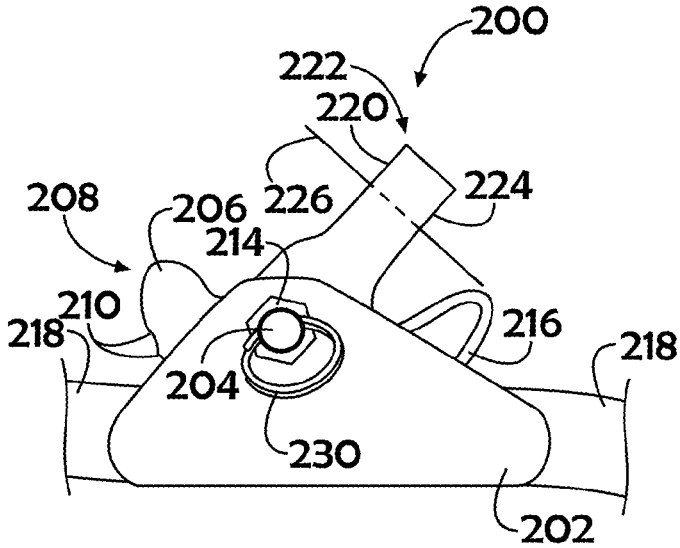

Referring now to FIGS. 2*a* and 2*b*, there are shown exploded and assembled pictorial, schematic views, respectively, of a LAD device in accordance with the present invention, generally at reference number 200. LAD 200 has a generally U-shaped body 202, having a pair of inside substantially flat sides parallel to one another, these sides defining parallel major planes 228.

Figure 1A:
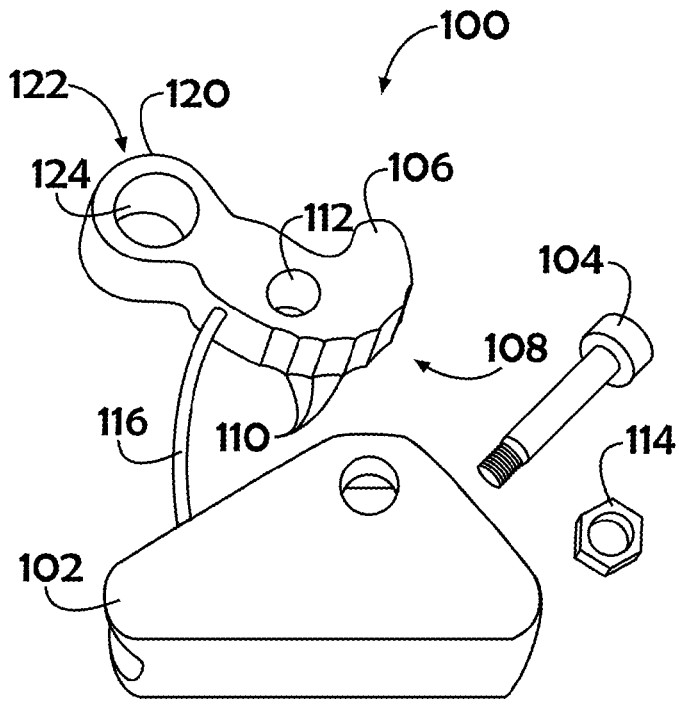
Figure 1a Prior Art
FIGS. 1*a* and 1*b* are exploded and assembled pictorial, schematic views, respectively, of a rope grab of the prior art.
Figure 1B:
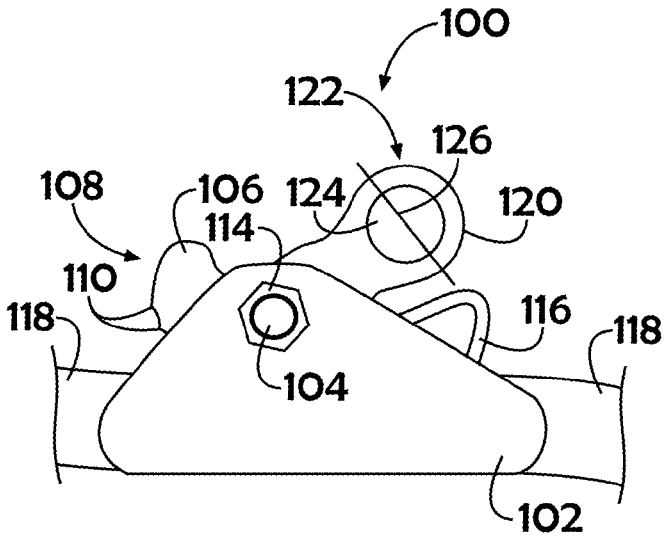
Figure 1b Prior Art

Cam 206, disposed within body 202 in a plane parallel to the parallel major planes of body 202, has a proximal cam end 208 with engaging teeth 210 disposed on a portion thereof. As may readily be seen, cam 206 has an eye 220 disposed at a distal end 222. Eye 220 is disposed at approximately 90° relative to eyes of all prior art rope grabs exemplified by eye 120 of prior art rope grab 100 as shown in FIGS. 1*a* and 1*b*. Eye 220 has a central eyehole 224 disposed therein. An axis passing through eyehole 224 is parallel to the major plane of body 202. Unlike eyehole 124 (FIGS. 1*a* and 1*b*), eye 224 has an axis 226 that is substantially parallel to major parallel planes 228 formed by the inside sides of body 202.

An axle or shoulder bolt 204 is provided to rotationally secure cam 206 within body 202. In the embodiment chosen for purposes of disclosure, axle (shoulder bolt) 204 is predrilled with a hole 232 to accept a split ring 230.

A hole 212 is also disposed through a central region of cam 206, sized to receive axle (shoulder bolt) 204. A gland nut 214 or the like, typically a Nylock® nut or equivalent, is used to secure axle (shoulder bolt) 204 and cam 206 within body 202.

A cable 216 is used to secure cam 206 to body 202 when LAD 200 is disassembled to insert a rope or webbing 218. Cable 216 is typically stainless steel although other suitable materials may be substituted.

The distal cam end 222 serves as a release to allow passage of rope or webbing 218 by causing rotation of cam assembly 206 around axle (shoulder bolt) 204. The rotation of cam 206 about axle 204 selectively engages and disengages the engaging teeth 210 against a rope or webbing 218 shown in a typical operating position in FIG. 2*b*. The movement of distal cam end 222 selectively allows and disallows passages of rope or webbing 218 through body 202, or, more accurately, the movement of LAD 200 along rope or webbing 218.

An optional split ring 230 may be placed through optional hole 232 in axle 204 to prevent accidental detachment of gland nut 214. It will be recognized that the novel LAD 200 of the invention functions either with or without split ring 230. However, greater safety is provided when split ring 230 is utilized.

In one typical operation, rope grabs 100 and LADs 200 in combination with work positioning lanyards, function as length adjusting devices. Such lanyards are believed to be known to those of skill in the art and form no part of the present invention. However, the use of a LAD 200 in combination with a lanyard illustrates the advantages of the novel LAD 200.

Figure 3A:
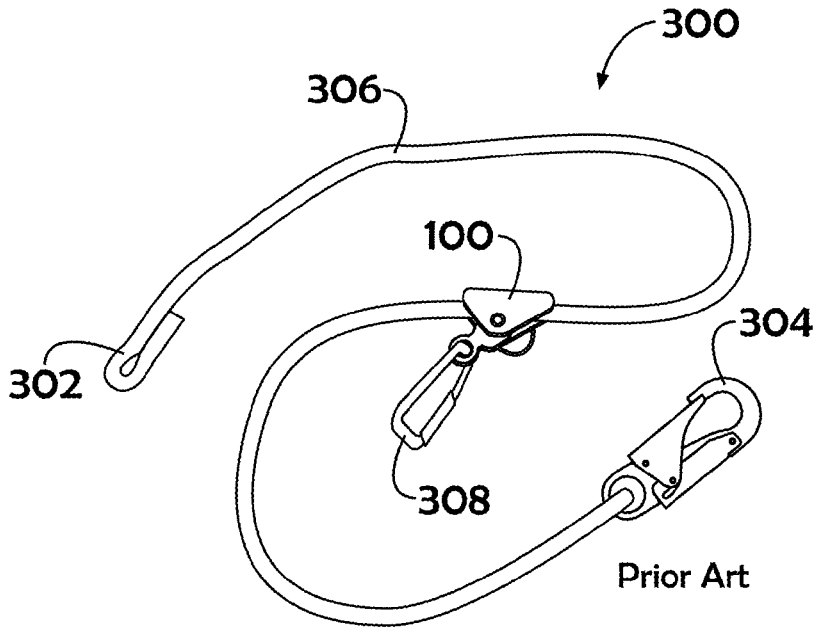
FIG. 3*a* is a top plan view of a work-positioning lanyard showing the prior art rope grab of FIGS. 1*a* and 1*b* in position thereupon.

Referring now also to FIG. 3*a*, there is shown a top plan view of a typical work-positioning lanyard, generally at reference number 300. Lanyard 300 has a rope-grab 100 of the prior art disposed thereupon, rope grab 100 serving as a length-adjusting device (LAD). Lanyard 300 has a stitched or spliced eye 302 at a proximal end and a snap hook 304 disposed at a distal end thereof. Other hardware known by those in the art may be used in place of a snaphook. Rope grab 100 may be selectively moved along the central length 306 of lanyard 300 as discussed hereinabove. A carabiner or the like 308 is attached to eye 120 of rope grab 100. The orientation of eye 120 causes carabiner or the like 308 to be disposed on edge as seen in FIG. 3*a*. As is discussed in detail hereinbelow, this carabiner or the like orientation can be problematic.

Figure 3B:
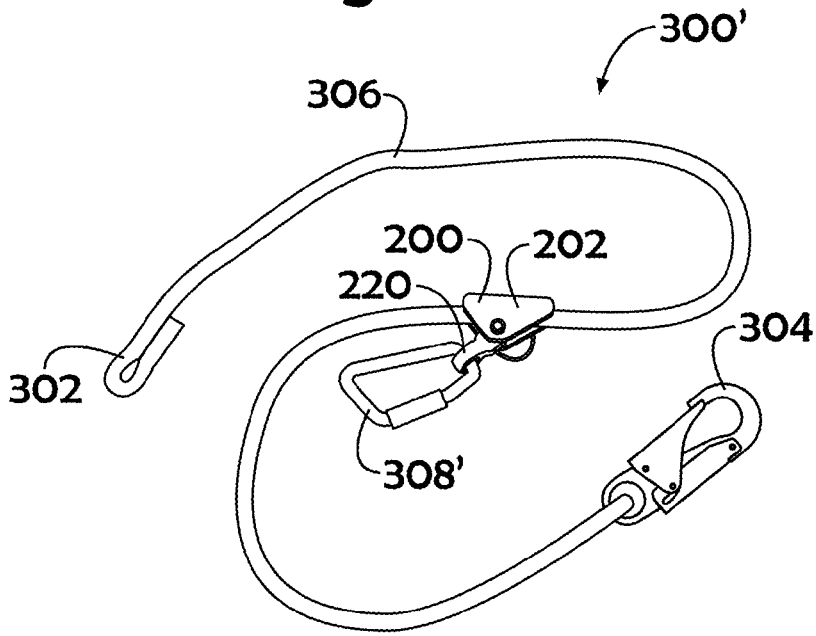
FIG. 3*b* is a top plan view of a work positioning lanyard showing the novel LAD of the invention, as shown in FIGS. 2*a* and 2*b*, in position thereupon.

Referring now also to FIG. 3*b*, there is shown a lanyard 300' that is substantially identical to lanyard 300 with the exception that rope grab 100 is replaced by the novel LAD 200 of the invention. As may readily be seen, carabiner or the like 308' attached to eye 220 of cam 206 (FIGS. 2*a* and 2*b*) lies flat on its side, an orientation made possible by the orientation of eye 220 relative to body 202 of LAD 200. This orientation is highly desirable.

Figure 4A:
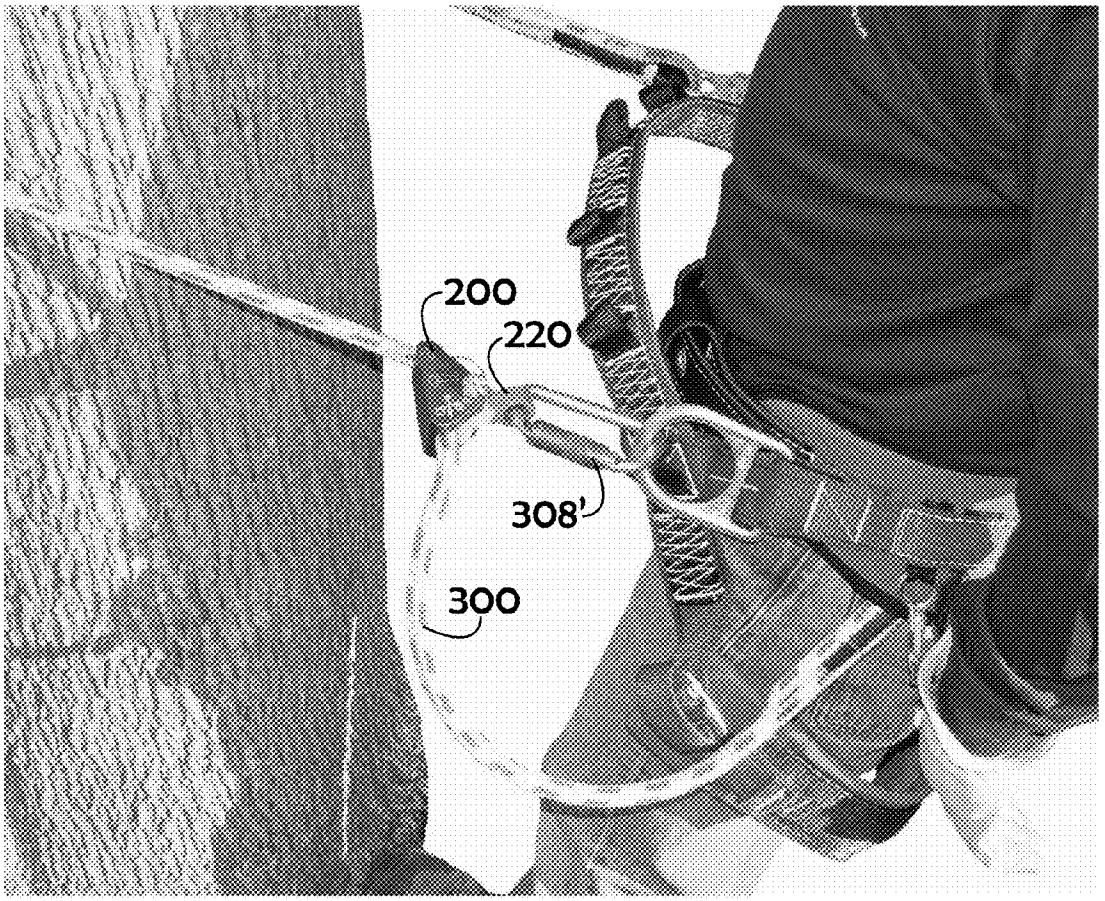
FIGS. 4*a* through 4*c* are photographs of the LAD of FIGS. 2*a* and 2*b* in combination with the lanyard of FIG. 3*b* in a typical operating deployment.
Figure 4B:
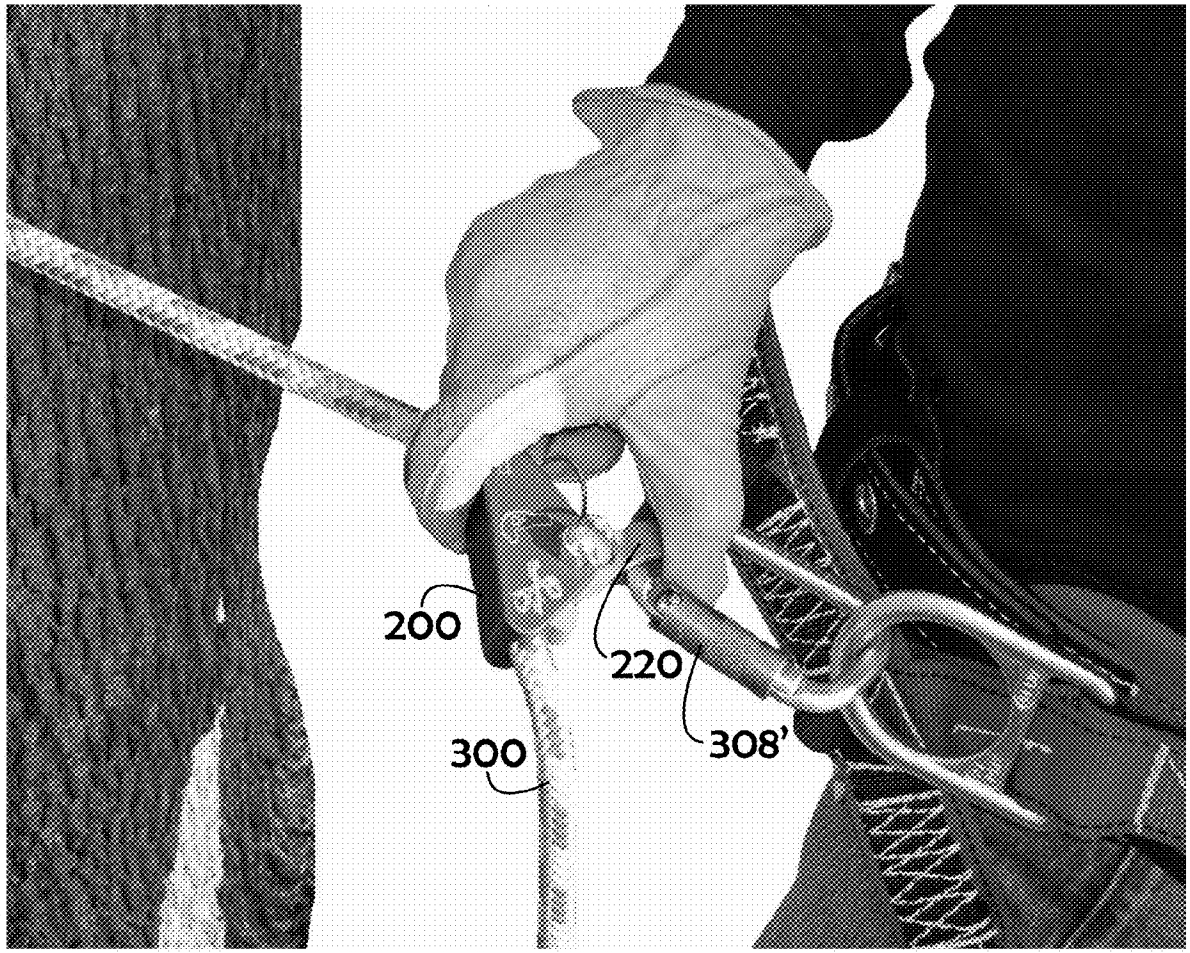
Figure 4C:
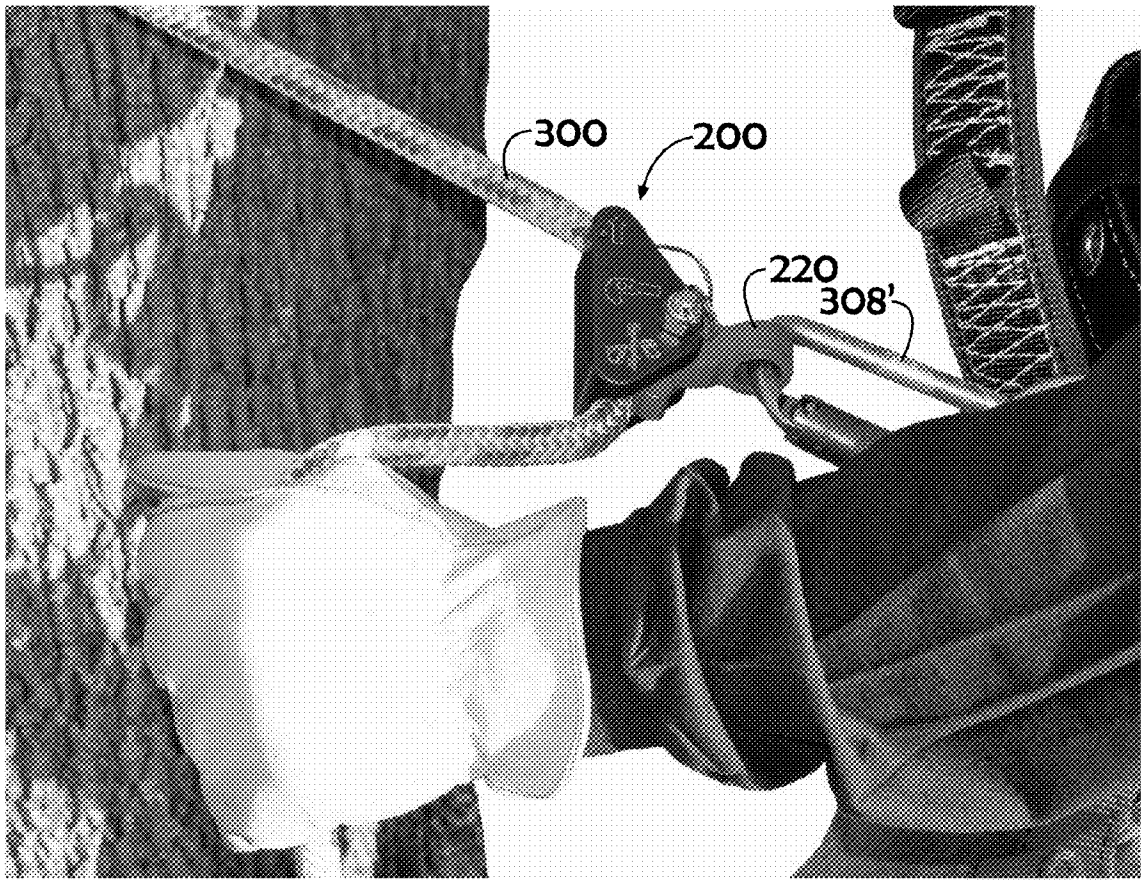

Referring now also to FIGS. 4*a* through 4*c*, there are shown pictorial views of lanyard 300' in its typical operating environment.

In FIG. 4*a*, a wearer has a positioning belt 402 attached via a D-ring 404 to eye 220 of LAD 200 by interposed carabiner 308'. An end of lanyard 300' is appropriately attached to another portion of the wearer's positioning belt 402. Lanyard 300' is shown encircling a tree, as is an example of a typical work positioning application.

In FIG. 4*b*, the wearer is shown poised to lengthen the portion of lanyard 300' encircling the tree. A thumb of the wearer's hand easily presses a protruding portion of cam 206 because of the horizontal orientation of carabiner 308. The optional elongated (with respect to the prior art) protruding portion of cam 206 makes applying pressure thereto easier when the wearer's hand is gloved. With prior art rope grabs (e.g., rope grab 100 as seen in FIGS. 1*a*, 1*b*, and 3*a*) carabiner 308 may interfere when hand making length adjustments, particularly lengthening of lanyard 300, resulting in more difficult and potentially more dangerous operations.

In FIG. 4*c*, the wearer is shown shortening the length of lanyard 300' encircling the tree.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A length adjusting device (LAD), capable of surrounding and selectively moving along a lanyard, said LAD comprising:

a) a substantially U-shaped body having a pair of, substantially flat, parallel sides, said sides defining parallel major planes of said body; and b) a cam having a proximal cam end comprising rope or webbing engaging protrusions on at least a portion thereof, and a distal, eye-bearing end, said cam, said cam being at least partially housed within said body between said pair of sides, said cam being disposed within a plane parallel to said parallel major planes;

c) a cylindrical eye with a cylindrical inner surface disposed in said eye-bearing end of said cam and having a central opening with an axis passing through said central opening, said axis being parallel to the cylindrical inner surface and said two major planes; and d) an axle pivotally connecting the body to the cam, the axle passing through a first side of said sides of said substantially U-shaped body, through an aperture of said cam, and through a second side of said sides of said substantially U-shaped body, the axle comprising a shoulder bolt having a head at a proximal end and threads disposed along a portion adjacent a distal end; and e) means for securing said axle in said body, said means for securing being operatively attached to a portion of said axle protruding beyond said second of said pair of parallel sides and comprising a nut secured to said threads and a split ring operatively connected through a hole in said distal end of said axle; and f) a flexible cable directly attached to said body and to said cam for assisting said cam to return to a closed position.

* * * * *